United States Patent [19]

Chaudot

[11] Patent Number: 4,506,735

[45] Date of Patent: Mar. 26, 1985

[54] OPERATING SYSTEM FOR INCREASING THE RECOVERY OF FLUIDS FROM A DEPOSIT, SIMPLIFYING PRODUCTION AND PROCESSING INSTALLATIONS, AND FACILITATING OPERATIONS WITH ENHANCED SAFETY

[76] Inventor: Gerard Chaudot, 14, Allee de La Rochefoucauld, 78570 Andresy, France

[21] Appl. No.: 500,622

[22] Filed: Jun. 3, 1983

[30] Foreign Application Priority Data

Jun. 8, 1982 [FR] France ..... 82 09975

[51] Int. Cl.[3] ..... E21B 33/037; E21B 43/017

[52] U.S. Cl. ..... 166/357; 166/363

[58] Field of Search ..... 166/356, 357, 363, 370; 405/224, 226

[56] References Cited

U.S. PATENT DOCUMENTS

| | | | |
|---|---|---|---|
| 2,767,802 | 10/1956 | Orrell | 166/357 |
| 3,754,380 | 8/1973 | McMinn et al. | 166/357 |
| 3,875,998 | 4/1975 | Charpenties | 166/357 |
| 3,881,549 | 5/1975 | Thomas | 166/357 |
| 4,239,510 | 12/1980 | Hays et al. | 166/357 |

OTHER PUBLICATIONS

Webster's New Collegiate Dictionary, Eighth Ed. 1977, p. 1085.

*Primary Examiner*—Stephen J. Novosad
*Assistant Examiner*—Mark J. DelSignore
*Attorney, Agent, or Firm*—Scully, Scott, Murphy and Presser

[57] ABSTRACT

A system involving at least one well equipped with an elevated or sub-sea production head, and at least one pipeline collecting the effluent from the production head leading to an effluent phase separation unit. The system comprises, in addition, a tube in the form of a U-tube connected to the unit and dipping into the sea to a predetermined depth; the exit in the sea of this U-tube can open into a balancing column that protects the air-sea interface from fluctuations due to the state of the sea. The invention also makes it possible to regulate the input pressure into the installations at a value which is preferably close to atmospheric pressure.

15 Claims, 7 Drawing Figures

OPERATING SYSTEM FOR INCREASING THE RECOVERY OF FLUIDS FROM A DEPOSIT, SIMPLIFYING PRODUCTION AND PROCESSING INSTALLATIONS, AND FACILITATING OPERATIONS WITH ENHANCED SAFETY

BACKGROUND OF THE INVENTION

1. Field of the Invention

The present invention relates to a system for working deposits of fluids, which in particular, but not exclusively, is applicable to offshore deposits of hydrocarbons, with the system being adapted primarily to increase the recovery of the fluids, especially when the fluids are under low pressure in the deposits, or are difficult to extract, and to simplify the installations and their utilization, while improving their safety in operation.

2. Discussion of the Prior Art

Generally, it is widely known that the working of offshore deposits of hydrocarbons requires the emplacement of a system which is constituted, as on land, primarily of wells equipped with subsea and/or raised production heads, connections between the production heads and production installations, wherein the connections can be very short if the production heads are close to the production installations, with the production installations themselves rendering it possible to separate and process the various phases of the effluent, and means for conveying the products extracted from the deposit to a storage location. All or portions of the arrangements described hereinabove are usually concentrated within one or more structures fixed to the seabed or are assembled on the decks of floating structures.

Depending upon the rate of flow, the nature of the effluent and the exterior environmental conditions, the mounting of the installations may necessitate the provision of supporting and protective structures reaching the limits of present-day technological capabilities. Finally, when the waters are of great depths and/or the encountered environmental conditions are extremely severe in nature, the adaptation of conventional working systems to these conditions becomes problematic, and generally extremely expensive.

Furthermore, the control of flows and pressures of the effluent, as well as those of the components employed to maintain them below a predetermined upper limit, in view of the high level of safety which is required in these confined installations, combine to render these systems highly complex, also requiring a relatively large number of skilled personnel to operate and supervise the systems.

Moreover, as on land, the recovery of the fluids in situ in the deposit will often be limited by an abandonment pressure which is a function of the depth of the deposit and the devices which may be utilized to assist with production until it reaches the installations for the separation and processing of the effluent.

Furthermore, in the case of fluids which are difficult to extract because of their physical characteristics and the conditions of the deposit, it becomes apparent that the movement of these fluids upwardly through the intervening water to the surface installations will tend to make the encountered problems more difficult to solve and, finally, will limit the flow from the wells and the recovery of the fluids from the deposit as a result of energy losses and reduction in the temperature of the flowing effluent, and thus raise the abandonment pressure for the deposit.

Finally, if the wells are equipped with subsea production heads, the maintenance of the wells, which is necessary during the life of a deposit, will be feasible cost.

SUMMARY OF THE INVENTION

Accordingly, it is a primary invention, depending on the type of deposit and the environmental conditions, to eliminate or at least alleviate the drawbacks which are presently encountered in the technology.

The invention contemplates a system of working which is constituted from all or part of a set of components or parameters which, depending upon the type of deposit, its evolution and the characteristices of the effluent, combine to:

(a) Allow for a reduction in the head pressure of subsea wells to a value which is a function of the vertical sea depth relative to the working installation.

(b) Ensure the safety of the installations upon the occurrences of excessive pressure by use of the pressure gradient produced by the depth of the intervening seawater at the site of location of the working installation; even in the case of partial or complete inoperation or failure pressure regulating systems or safety devices for limiting the pressure.

(c) Ensure the safety, and even allow for continued working, in the event of flooding of the installation by liquids, either naturally or through operational failure of the level-regulating systems in the installations.

(d) Allow for the storage of the effluent over a limited period of time, so as to facilitate continued working during interruptions in the evacuation of the product.

(e) Depending upon the arrangement of the working wells, consider their execution and/or access thereto for control, measurement and maintenance, and also for replacement of equipment inside the wells.

(f) Facilitate working of the deposits by a simplification of the installations and controls, rendering it possible to propose full automation or remote control operation.

(g) When the working installation is connected to the wells through swivel joints, reduce the stresses generated by the pressure in these joints by restricting this pressure.

(h) When the installation is fixed to the seabed, reduce the loads at the head by the installation of a substantial portion of the operating equipment in the subsea marine part of the supporting structure, conjointly with a reduction in the safety stresses related thereto.

(i) Reduce the volumes and bearing surfaces of the installations situated in the raised and subsea regions proximate to the surface of the sea, wherein the maximum stresses and hazards generated by the environment are usually encountered.

(j) Depending upon the type of embodiment, allow for a fast disconnection of the wells and working installation when this equipment is located in a region where there is encountered the risk of random passage of foreign objects which are difficult to detect.

(k) Allow for varying the temperature of the effluent, as well as the injection of various additives, and easily controlling the effects thereof in the wells, or at least from the well-heads when the latter are below the water level.

(l) Improve the separation of the effluent from the wells by increasing the periods of retention of the latter in the installations, without this leading to excessive physical dimensions and construction costs.

(m) Reduce the actual investment costs, and facilitate the subsequent use of the working installation for another deposit or for another part of the deposit, thus permitting the operation of deposits which are considered to be marginal or questionable profitability when their working is contemplated through more traditional technologies.

In order to achieve these results, the invention has as its object to regulate, in a particularly simple and reliable manner, the input pressure in the installations to a value that is, preferably, close to that of the atmospheric pressure prevailing at the depth at which this input is located allowing for the density of the gas phase of the effluent or the gas ceiling maintained in the system.

Considering the foregoing, in a system incorporating at least one well equipped with a raised or subsea production head, and at least one pipeline conducting the effluent from the production head to at least one buffer container and/or an effluent phase-separation unit which preferably is situated at the inlet to the installations, the invention proposes to connect to the container and/or to the separation unit, a tube in the form of a siphon dipping into the sea to a depth which is a function of the maximum pressure which it is desired to obtain in the container or in the separation unit.

More specifically, this inventive working system can therefore incorporate, depending upon the conditions of the deposit and the characteristics of the effluent, all or some of the following components, as viewed in the direction of flow of the fluids:

(1) One or more wells, with a subsea or raised production head, situated at a distance from, perpendicular to, or inserted in the production installation and providing a connection between the productive bed and the seabed, or the surface of the sea.

(2) At least one flexible or rigid pipeline for conveying the effluent from the production head to a system of valves located at the inlet to the working installations, making it possible to convey the effluent to different points in the installation, and to shut off or regulate the flow from the wells in conformance with the working program.

(3) A buffer container and/or an effluent phase separation unit, with one or more separation pressure stages in which the pressure in each stage will be or can be governed by the actual pressure generated by the height of the intervening water considered between the position of the gas-liquid interface in the siphon and the surface of the sea. In this instance, the gas phases which are separated in each stage can be vented along two paths which are always simultaneously in service; one path conveying the gas directly to atmosphere through a valve or a device regulating the flow of gas as a function of the position of the gas-liquid interface in the separator and/or of the pressure prevailing in the latter and the other path communicating with the sea, by means of a siphon adapted to open into a balancing column protecting the sea-atmosphere interface from water level fluctuations caused by swell, waves and atmospheric conditions, and concurrently preventing the direct dumping into the sea of liquid pollutants which may be entrained in the gas. The level of the liquid in the separator can be controlled by an internal and/or external detector which, in conformance with the needs of the installation, as a nonlimiting example, actuates a valve regulating the liquid flow or, for example, an evacuation device constituted of a pump, or simultaneously both of these.

In view of the arrangements provided above, on the one hand, the regulation of the flow of the primary production installations is effected with great simplicity and can be remotely controlled, for example, from the surface, and is easily automated while, on the other hand, the statutory regulations relative to the safety protection of pressurized containers are no longer applicable since the containers are permanently opened to atmosphere through the sea.

In various embodiments or applications in which the separation pressures must reach values incompatible with the depth of water available at the site of the installation, the statutory provisions relative to the protection of pressurized containers will have to be applied. However the outlets from the devices limiting the pressure in the containers which can be subjected thereto, are designed to open into the stack of a flare or of a vent open to the sea in the lower region thereof so as to dampen pressure surges when they trip, and restrain the entrainment of liquids in the venting section.

BRIEF DESCRIPTION OF THE DRAWINGS

Preferred embodiments of the invention are now described herein below by way of operative examples, having reference to the accompanying drawings; in which.

DETAILED DESCRIPTION

Figure 1:
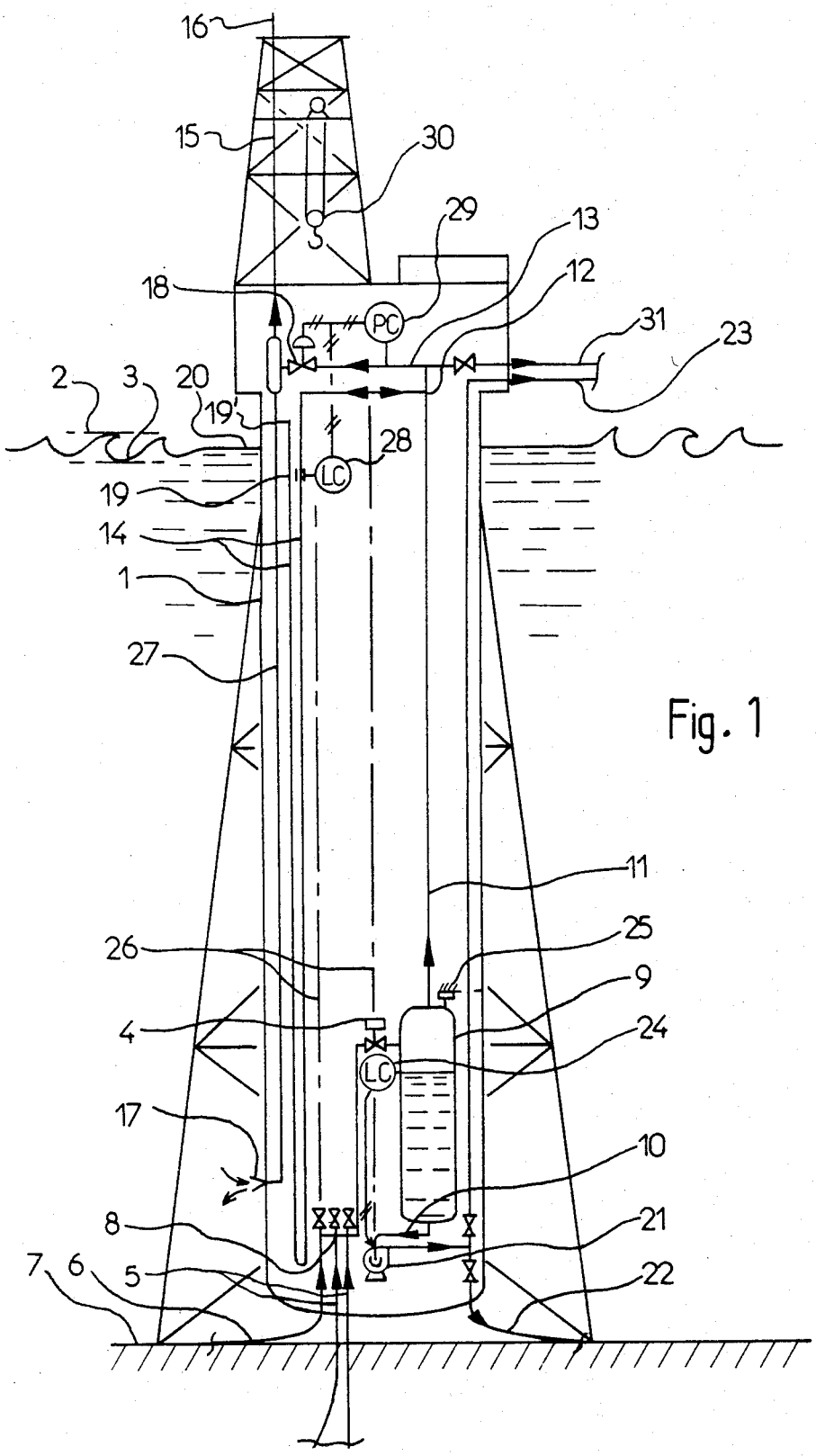
FIG. 1 is a schematic representation of a first embodiment of a working system, shown simplified to clearly elucidate the principles applied to the solution of the problems encountered in the working of a new deposit, or one being currently worked, in which the pressure, the external conditions and/or the characteristics of the effluent tend to limit the flow from the wells, and also the recovery of the fluids present in the deposit.

The working system represented in FIG. 1 is principally distinguished by the aspect in that the input pressure into the installations can be close to atmospheric pressure even if this input is located at any depth within the intervening seawater.

This system includes a single effluent separation stage and comprises, primarily, a tight hu11 1 supporting the stage and protecting it from the environment and which stands in the sea, the high and low levels of the sea being indicated by reference numerale 2 and 3, and the seabed by reference numeral 7. The installation is supplied with fluid by vertical and offset wells 5 and collection lines leading from distant wells 6, connected to a system of valves 8 including devices necessary to regulate the flow from the wells, such as valves and nozzles. The system of valves 8 is connected to the input of a separator flask 9 through a cutoff safety valve 4. This separator flask 9 has a liquid outlet 10 and a gas outlet 11.

The gas outlet 11 is divided at 12 into two lines 13 and 14, conducting the gas to the atmosphere along two different paths. Line 13 is connected at its elevated part to a flare 15 open to the atmosphere at 16, through a regulator valve or calibrated check-valve 18, and open to the sea at 17. Line 14 is in the form of a u-tube, and communicates with the sea at 19 and with the downward extension of the flare stack at 19', these two lateral pipe connections being located in the vicinity of the sea-atmosphere interface 20 and protected by extension 27 of flare stack 15. A pipeline 31 permits the taking gas samples when required for various purposes. Depending upon the calibration of the check valve or regulator valve 18, the pressure in separator flask 9 can be set to range from a value close to that of atmospheric pressure up to a value corresponding to the depth of u-tube 14 in addition to a margin of safety. Regulator valve 18 may be operated either by a level detector 28 positioned on the descending part of u-tube 14, or by a pressure detector 29, or by both simultaneously, one being a back-up or stand-by for the other. Nevertheless, for certain deposits in which the pressure will not permit a flooding of the installation, devices 18, 28 and 29 can be replaced by a flame-retarder. It is clear that with this arrangement, the pressure prevailing in separator flask 9 cannot, in any case, exceed the value corresponding to the depth of the flask below sea level.

The liquid outlet 10 is connected to a member 21 for evacuation of the liquid products toward complementary processing and/or storage installations by rigid and/or flexible aerial and/or submerged pipelines 23, 22. Member 21 for evacuating the fluid products can be constituted from pumps of different types, of either the centrifugal or piston type, driven by an electric, hydraulic or pneumatic motor, by hydraulic or pneumatic ejectors and by flushing gas. The separator flask 9 possibly may constitute the container necessary for embodying the evacuation means, and the gas withdrawn at 31 may be the motive fluid after compression. Furthermore, the duplication of separator flask 9 makes it possible, in the latter case, to ensure a continuous flow from the wells.

Regulation of the evacuation of the flow of liquids will be ensured by either or both types of devices as described above, in order to render certain the proper operation of the system. A first device will assist in actuating the pumping means 21 with the aid of a level detector 24 having a float, magnetic, with capacitive or other effect, inside or outside the fluids contained in separator flask 9 and with direct or indirect effect, possibly in conjunction with a second device constituted by weight cells and/or stress gauges 25 outside the container 9, any one of these devices acting as a back-up or stand-by for the other, in order to reduce the phenomena of foaming of the effluent which is frequently encountered, and affording classic level detections.

Means for heating or cooling of the effluent, not shown, from the wells up to the evacuation of the separated fluids, can be incorporated in the installation, without thereby giving rise to unacceptable interference or stresses. However, for the working of certain deposits, it may be advantageous to be able to heat-insulate the wells from contact with the sea, in the depth of the intervening seawater through which they pass, this being provided by hull 1.

A vertical access 26 and handling means 30 are arranged to permit direct access to the wells 5, the pumping means 21 and the separator flask 9, for measurements, sampling and maintenance, and replacement, as well as direct operation of the valves and nozzles of the valve system 8.

There is thus obtained a working system with a number of advantages, among which are:

1. A substantial increase in the natural flow from the wells, even rendering the latter eruptive by reduction of the head pressure correlative with a lowering of the point of input of the fluids into the installation and the low pressure that can prevail there, and by thermal protection in the intervening water through which it passes.

2. An increase in the recovery of the fluids in place in the deposit, resulting from the reduction in the abandonment pressure.

3. A very high flexibility of operation and of adaptation to different cases of operation merely by effectuating adjustments at the surface.

4. An extremely high level of safety in the case of entrainment of liquids in the gas and a substantial reduction in the risks of pollution by hydrocarbons.

5. The possibility of relieving the installations of equipment and stresses corresponding to the statutory protection of pressurized containers, the latter being permanently open to the atmosphere through the sea provided, however, that the latter are designed to withstand the pressure prevailing at the depth at which they are installed.

6. Continued access to the wells for measurements, sampling and maintenance, this access being facilitated by the height available in the installation.

7. A substantial reduction in the head load and the volumes required at the surface by incorporation of a part of the installations in the submerged part of the support, thereby lowering the center of gravity and reducing the stresses generated by the outside medium.

Figure 2:
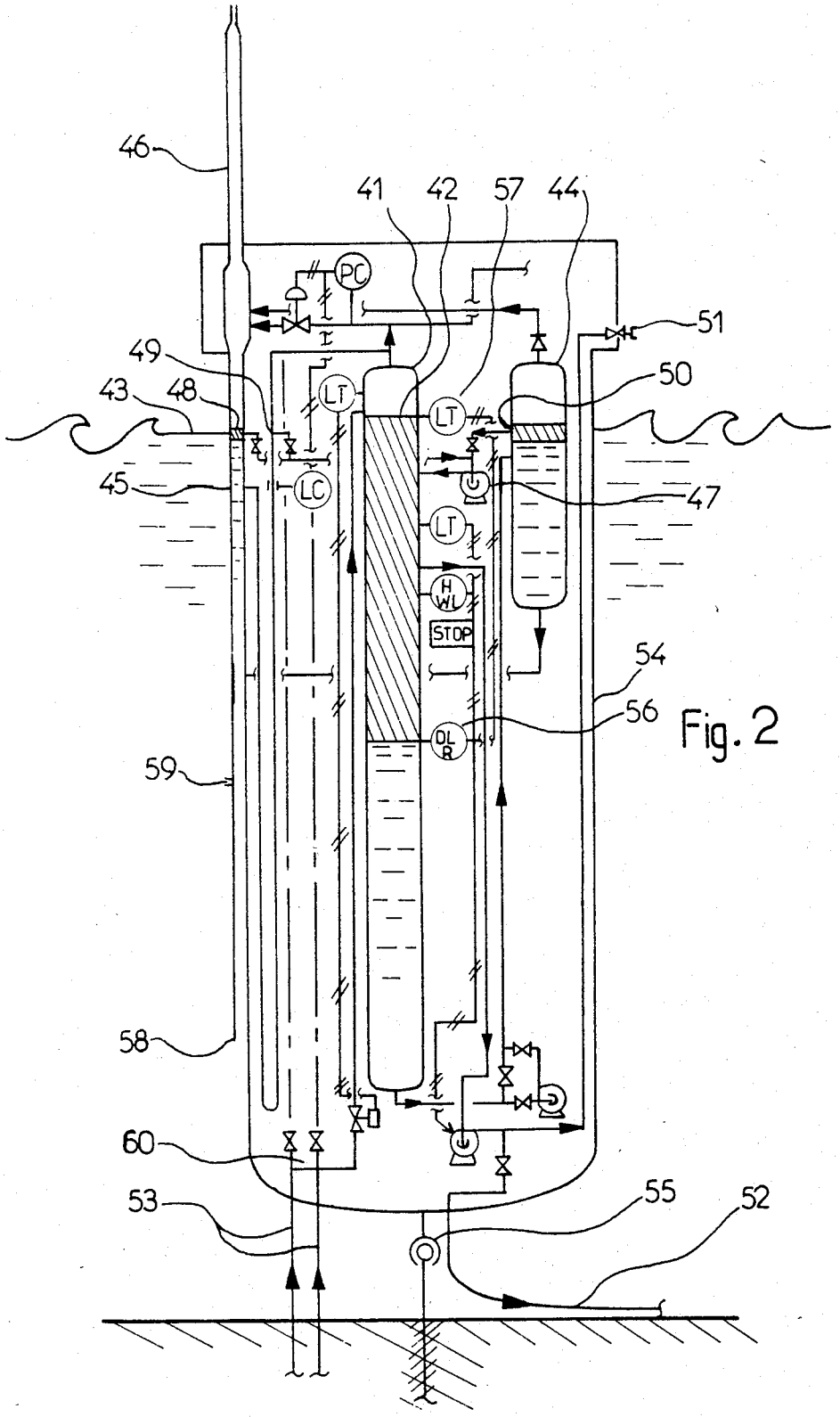
FIG. 2. is a schematic representation of a second embodiment of a working system in which two liquid phases, for example, crude oil and water can be separated, and which also includes a large holding tank to possibly allow breaks in delivery without thereby halting the production of the wells.

Referring to FIG. 2, the installation has a single separation stage but differs from the preceding embodiment in that the level of the gas-liquid interface 42 in the separator flask 41 can lie in the vicinity of the level of the exterior air-sea interface 43 when the separation pressure is close to atmospheric pressure, and in that, when the liquid effluent consists of two phases such as crude oil and water, for example, the aqueous phase is purified from the residual oil in a second separator flask 44 before being ejected to the sea through extension 45 of flare stack 46, so as to ensure a sufficient degree of purification of the waste water. Furthermore, extraction means 47 will permit picking up the oil or the mixture of imperfectly separated oil and water at 48 in the flare-stack extension, at 49 in the descending part of the balancing u-tube and at 50 in the oily water separating flask. Depending upon the volumes imparted to the separator flasks 41 and 44, the latter can also serve as buffer storages permitting interruptions in the delivery of oil at 51 or 52, while maintaining production from the wells 53. The protective hull 54 can be fixed on the seabed by means of a universal joint 55 or a fixed structure (jacket) as shown in FIG. 1, or by any other means, such as stretched cables, conventional anchors, or may even be incorporated in a concrete structure.

Regulation of the liquid flow in the installation is effected by means of a level detector 56 as a function of the variations in the oil-water interface and/or a level detector 57 of the gas-oil interface; the latter two detectors can be used simultaneously, or one as a stand-by for the other. Since the fluctuations recorded by the detectors are representative of a difference in volumetric mass between the oil and the water, the result provides for working with very high flexibility. In the event that the oil produced was of a volumetic mass greater than that of the water, the oil will have to be heated to reverse the difference in volumetric mass, otherwise the controls must be modified to allow for the fact that the water will float on the oil. The extension of flare stack 45 will then be closed at its lower end 58 and will have a lateral opening 59 to the sea.

Depending upon the pressure available in the wells, the system of input valves 60 can be placed either close to the bottom of the installation as represented, or on the surface, or in both ways successively during the life of the deposit with, however, vertical access to the wells being maintained.

Figure 3:
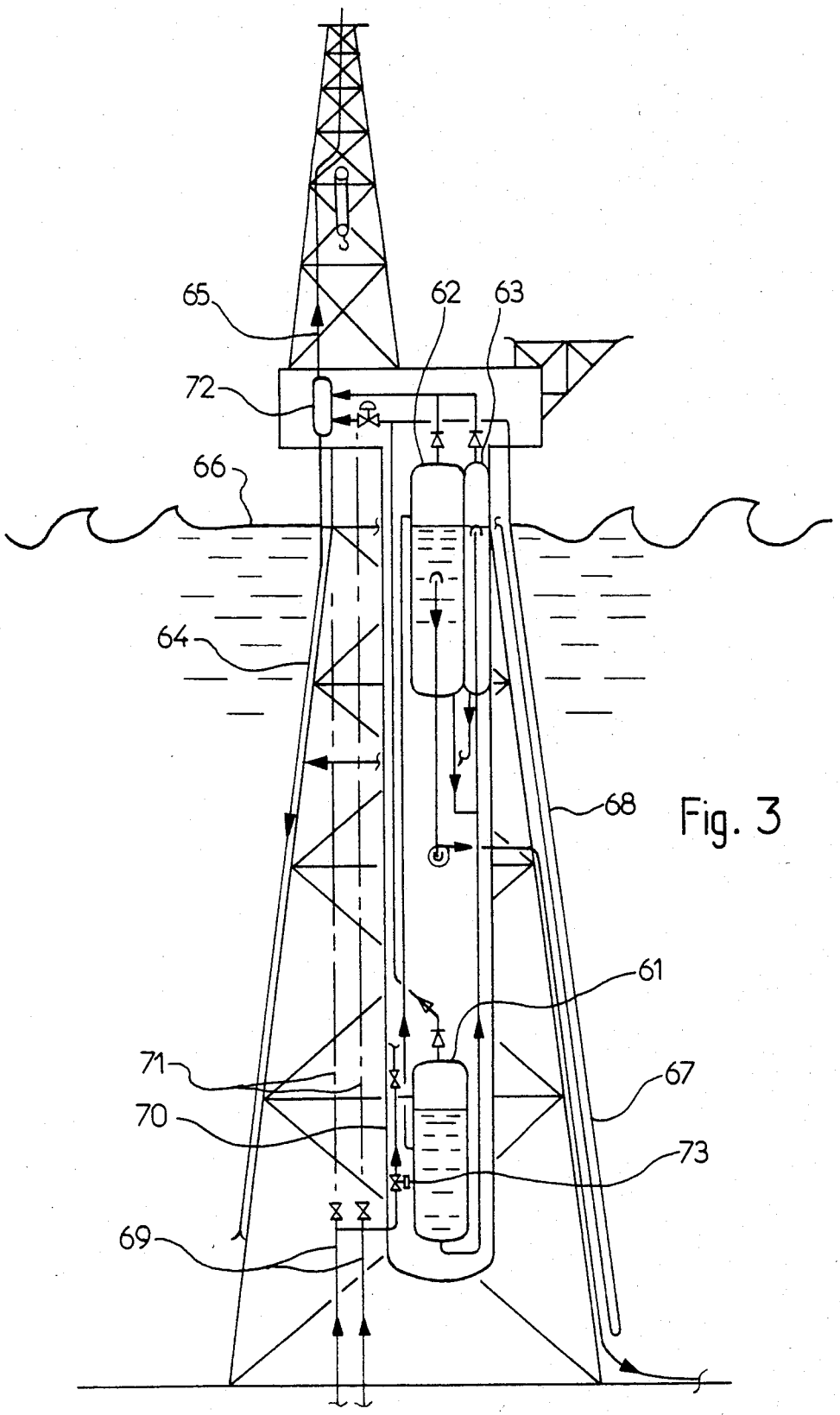
FIG. 3 is a schematic representation of a third embodiment of a working system in which the degasification of the effluent takes place in two pressure stages with separation and processing of the aqueous phase, and in which the upper terminal part of the wells is external of the protect of the separation installations.

Referring to FIG. 3, the installation has arrangements similar to those represented in the preceding figures, but differs from them to the extent in that it provides for separation in two pressure stages in the separator flasks 61 and 62, the aqueous phase being cleansed from oil in a container 63 connected to the sea as herebefore by means of extension 64 of the flare stack 65.

The actual separation pressure in separator 61 will then be conditioned by the height of the column of water measured between the air-sea interface 66 and the gas-water interface 67 in the descending part of the balancing u-tube 68. Separators 62 and 63 can work in a manner similar to that shown in FIG. 2. It is also shown that wells 69 can be located outside the protective hull 70, their vertical access 71 being maintained, for example, in the eventuality of the production of particularly toxic and/or corrosive fluids. The lower elevated part of flare stack 65 is equipped with a flare-foot flask 72, avoiding the entrainment of liquids in the flare nose section in the event of flooding of separator flask 61, and the failure of the safety systems in closing the input cutoff valve 73.

Figure 4:
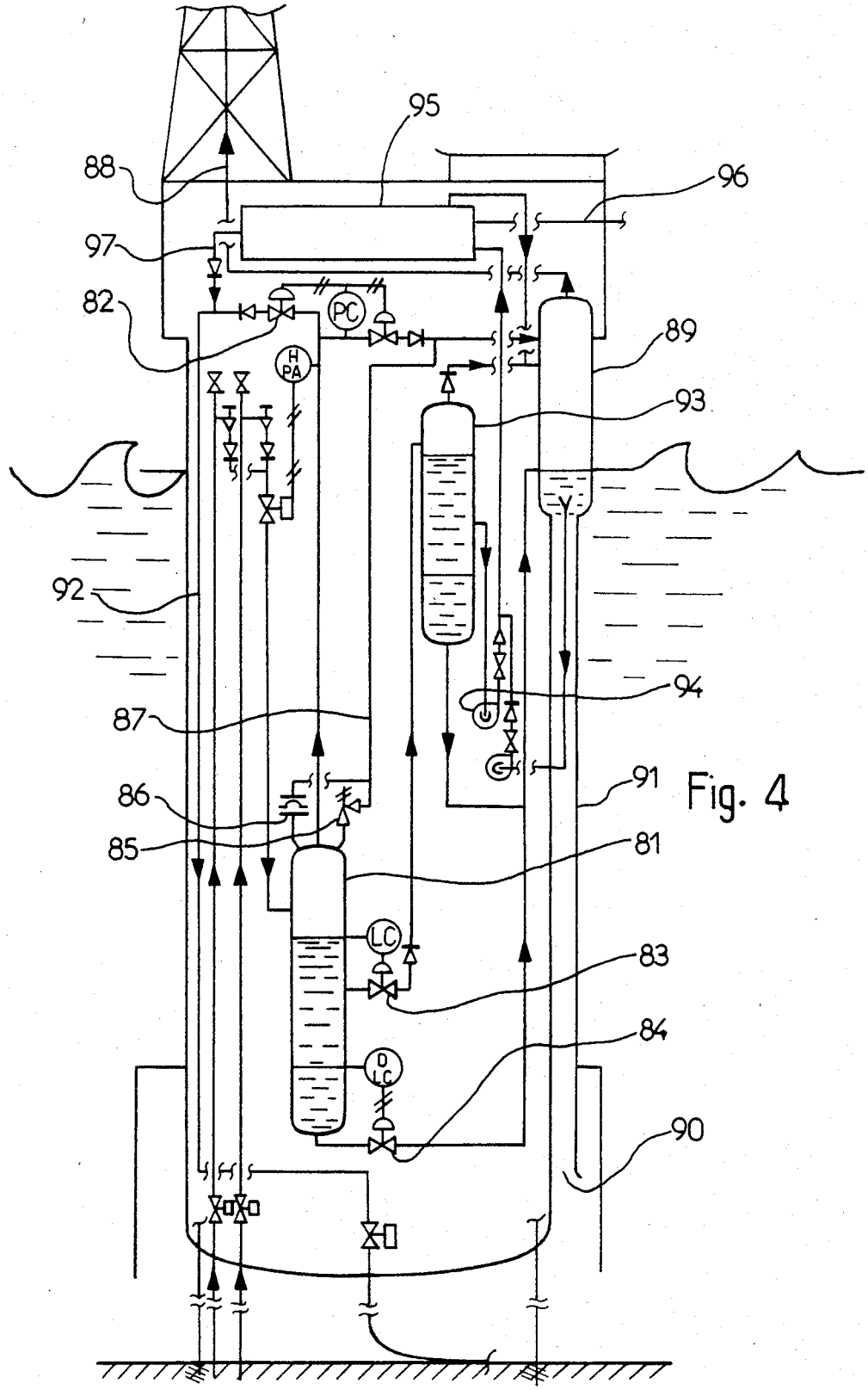
FIG. 4 is a schematic representation of a fourth embodiment of a working system in which the degasification of the effluent takes place in two pressure stages, but in which the separation pressure in the first stage is higher than the available pressure generated by the balancing water column at the selected depth.

Referring to FIG. 4, the installation, differing the arrangements similar to the preceding embodiments, shows a separation with two pressure stages, in which the working pressure of the first separator flask 81 is higher than the pressure generated by the intervening seawater that is traversed, which can be used for regulation of the pressure in the separator. This separator flask 81 is normally equipped with a pressure regulator 82 and liquid level valves 83 and 84. It is protected against accidental excess pressures by safety valves 85 and rupture plates 86 whose evacuation pipes 87 are connected to the flare or to vent 88 through a flare-foot flask 89 open to the sea at 90 through a downcomer 91.

This arrangement makes it possible to attenuate the abrupt pressure rise in flare 88 upon the sudden tripping of safety devices 85 and/or 86, and any corresponding vibrations; as well as it will permit collecting the entrained liquids, or the foaming produced by rapid decompression of the fluids in separator flask 81, before they reach the nose section of the flare and thereby create a particularly dangerous situation.

The gas emanating from separator flask 81, after pressure regulation at valve 82, is conveyed through pipeline 92 when the pressure thereof is sufficient to cease it to reach the positions of use. The gas can be processed and recompressed at the surface (installations not shown) before entering duct 92.

The oil and/or the condensates stabilized in separator flask 93 are raised by a pump 94 in a processing unit 95 before delivery through a special pipeline 96, or mixed with the gas in duct 97. This installation is particularly applicable to deposits in which the principal effluent is gaseous.

Figure 5:
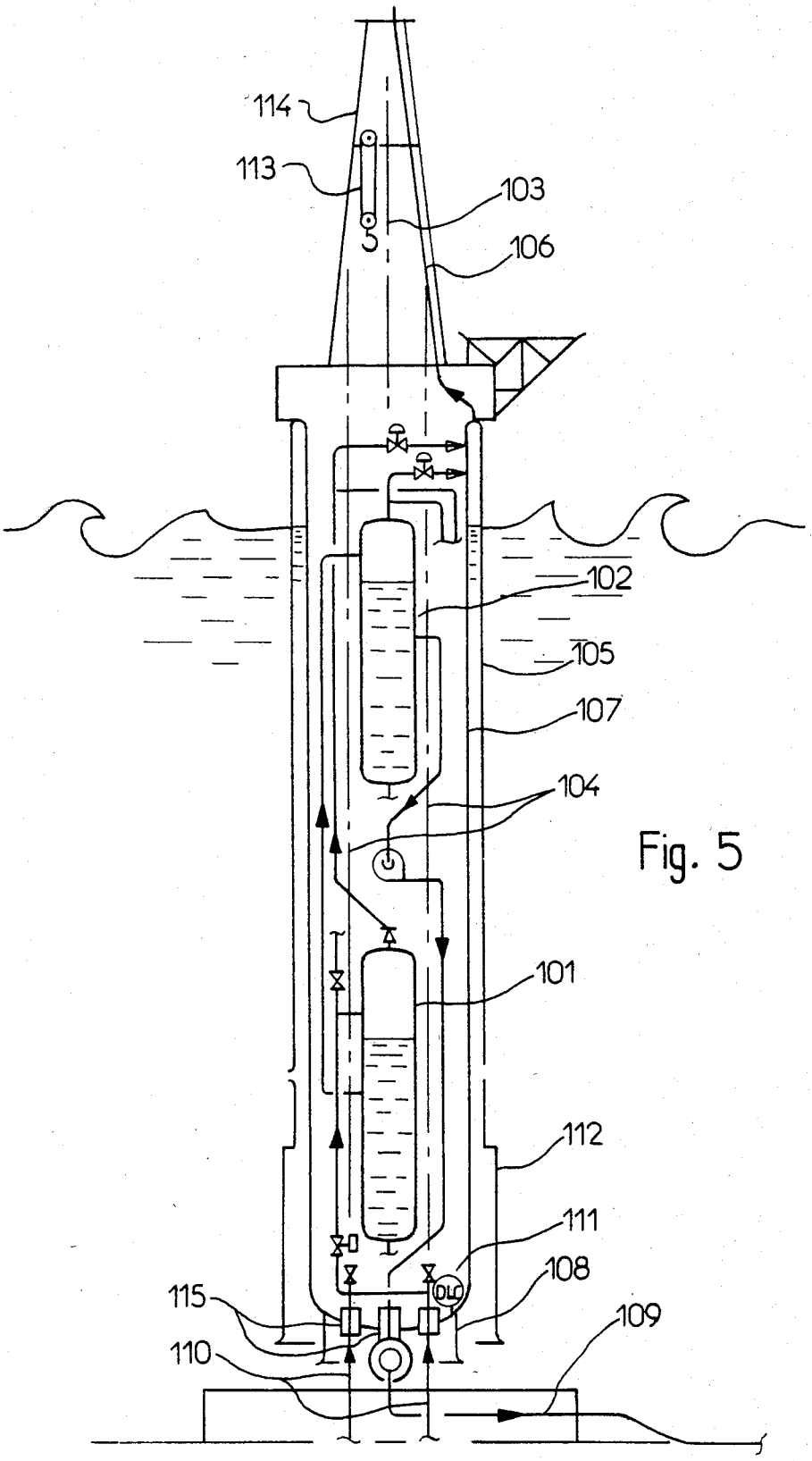
FIG. 5 is a schematic representation of a fifth embodiment of a working system in which the separation installations are disposed along the general axis of the principal supporting structure and in which the axes of the wells are arranged on the surface of a cylinder surrounding the separation installations.

FIG. 5 shows a particularly advantageous arrangement of the elements constituting the installation, characterized in that all of the elements are centered on the principal vertical axis of the structure which has a generally cylindrical form. In particular, the separator flasks 101 and 102 have their axes coinciding with, or very close to the principal axis 103 of the overall installation. The axes of the wells 104 are distributed about a cylindrical surface with an axis 103, and the downward extension 105 of the flare stack 106 is constituted by a cylindrical skirt completely surrounding the hull 107 of the installation. A short skirt 108 placed below hull 107 surrounding all of the connections of the pipes outside the installation 109 and the wells 110 makes it possible, by means of a leak detector differential level controller (DLC) 111, to obtain continuous information over the state of tightness of the connections. A flaring 112 of the skirt 108 at its base affords for greater stability of the overall structure, if necessary.

The support of the flare 106 and the handling means 113 for the equipment connected to the wells can be provided by a hull 114 of generally conical shape, making it possible to reduce the screen effect under outside loads, to maintain an acceptable temperature therein and, likewise, to permit operations independently of external oceanic and weather conditions.

Moreover, if the bottom connections 110 and 109 are equipped with rapid safety disconnectors 115, the installation can be unmoored within a very short time, making it possible to avoid objects floating on, or drifting in the sea, such as for example, icebergs. In addition, the skirt 105 around the right hull 107 of the installation will be able to assume an important part in taking up the stresses to which the installation is subjected, and constitutes a barrier at the level of the air-sea interface adapted to absorb energy in the event of a collision.

The result is a streamlined pencil-shaped installation of small diameter and great height, offering a minimal surface section exposed to the effects of the medium in which it is immersed and, more particularly, is suitable for deposits located in difficult environmental conditions, but limited in water depth by the type of attachment at the seabed.

Figure 6:
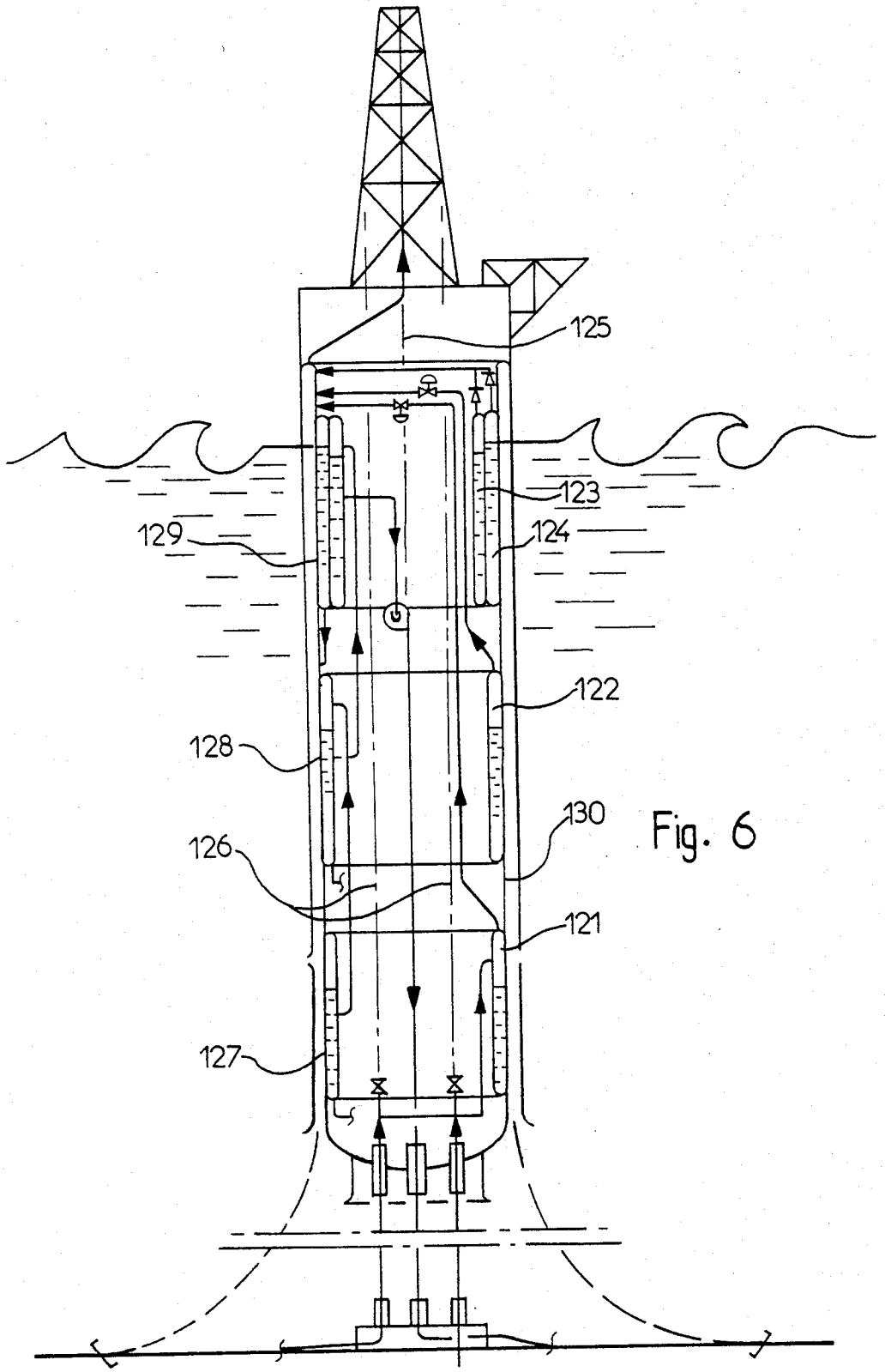
FIG. 6 is a schematic representation of a sixth embodiment of a working system having three separation stages at different pressures with separation and processing of the aqueous phase.

FIG. 6 illustrates another particular arrangement of the invention involving three separation pressure stages 121, 122, 123 as well as a flask for processing oily water 124, working on the principles described hereinabove.

According to this arrangement, the elements constituting the installation (particularly the separator flasks) are centered on the principal vertical axis 125 of the structure which has a substantially cylindrical shape.

The separator flasks have a circular or toroidal annular section in which the inner spaces allow sufficient room for access to the wells 126. The cylindrical outside portion of their jackets 127, 128, 129 can constitute all or a portion of the fairing skirt 130 of the overall installation.

Depending upon the relative overall dimensions of the equipment, the number of wells which are to be connected and the type of effluent, this arrangement can have a certain advantage compared to the preceding embodiments. Since the pencil-shape of the installation is retained, if the latter is attached to the seabed with the aid of, for example, conventional catenary anchors, this installation can then be located in very deep waters.

Figure 7:
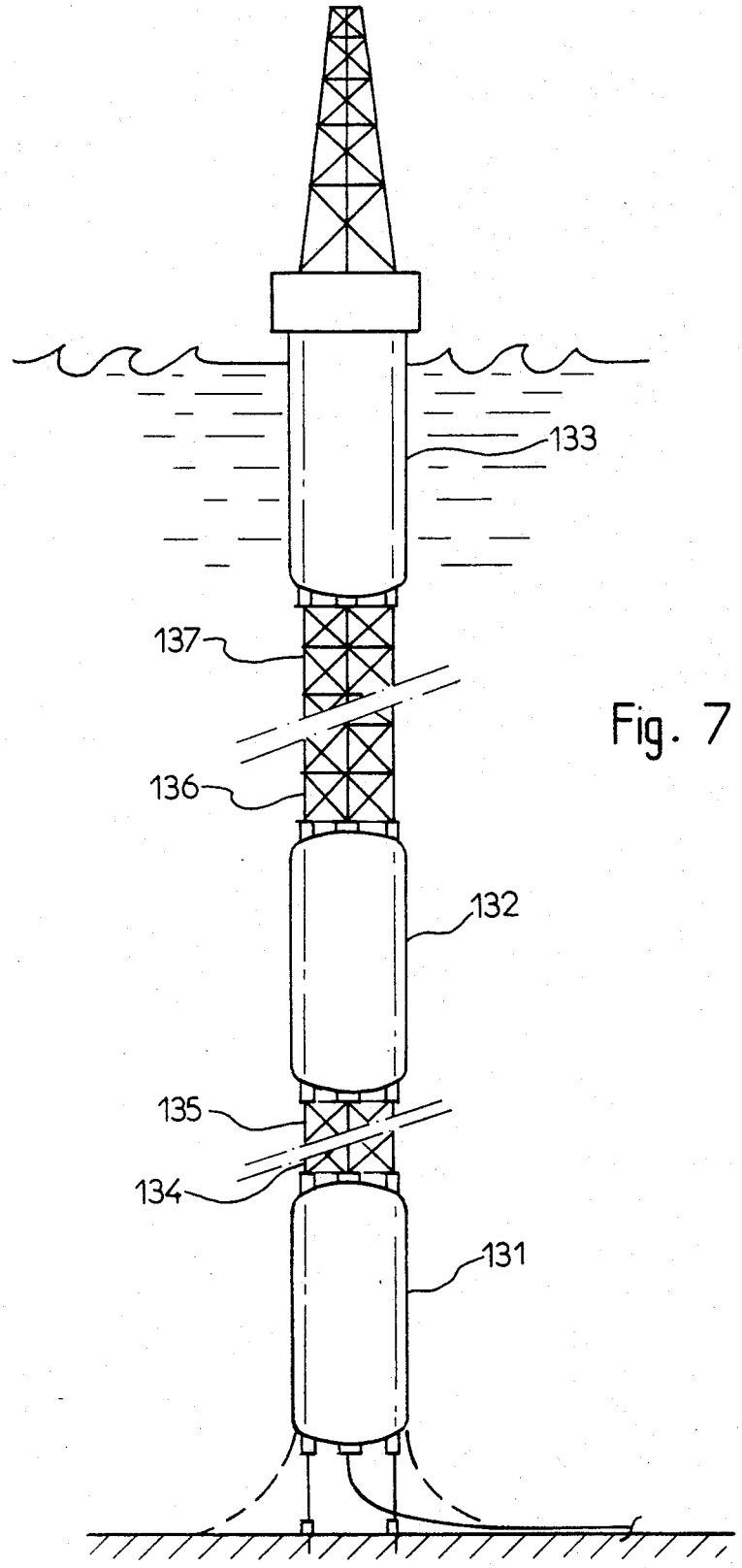
FIG. 7 is a schematic representation of a seventh embodiment of a system with a modular structure.

FIG. 7 shows another particular arrangement of modular type, affording by way of example, a three-stage separation, each stage being incorporated with its accessories within modules 131, 132, 133; connecting pieces 134, 135, 136, 137 providing the juncture between the various working modules and permitting an adjustment in height of the installations to the required conditions of buoyancy and particular water depth. This arrangement will facilitate transportation of the installation over long distances and/or under difficult sea conditions, as well as its emplacement at the site of the deposit. It also permits disposing interchangeable, standard elements to a great extent, whose manufacturing costs can be economical and allowing for relatively rapid modifications of the installations, or effecting repairs in case of damage.

Moreover, for certain deposits, which are shallow but situated in deep water, whose wells cannot be offset in order to combine production heads, or for deposits which are too extensive, each well or small group of wells can be worked by this system, all of the production being collected in central processing and delivery installations.

What is claimed is:

1. In a system of working deposits adapted to increase the recovery of the fluids in situ, including at least one well equipped with an elevated or subsea production head, and at least one pipeline collecting the effluent from the, production head communicating with at least one buffer container and phase separation unit for the effluent at the inlet to processing installations, wherein in order to regulate the input pressure in the installations at a value close to atmospheric pressure at the depth at which said inlet is disposed, the improvement comprising a tube connected to said container or to said separation unit, said tube being a u-tube dipping into the sea at a depth which is a function of the maximum pressure required in the container or the separation unit, and an outlet to the sea of said u-tube opening into a balancing column protecting the air-sea or gas-sea interface from fluctuations due to the condition of the sea and the atmosphere, such as covered by swell or waves; and a tube connected to the atmosphere through an upstream pressure control means permitting the escape of the gas.

2. System according to claim 1, wherein the balancing column comprises a downward extension of a flare stack or a vent to the atmosphere for the gases.

3. System accordhng to claim 1, wherein the water outlet of the separator flask is connected to the sea, either directly or through an oily-water processing flask through a pipeline constituting a u-tube opening into a balancing column open at the bottom to the sea, said pipeline preventing for a predetermined time the direct ejection into the sea of polluting liquids and liquids endangering the installation even during liquid flooding of the separator flask, and a pump for pumping liquids and reintroducing them into the installation or evacuate the liquids.

4. System according to claim 1, wherein the balancing column comprises a skirt enveloping the installations, said skirt being adapted to contain a desired quantity of liquid, and constituting a reinforcement of a supporting structure, particularly in the vicinity of the air-sea interface, said skirt being configured to allow for the energy to be absorbed by warping in the event of a collision.

5. System according to claim 1, wherein the outer wall of the separator flask comprises at least a part of the outer protective envelope of the installation, the production, injection or control wells being adapted to be disposed inside or outside the protective envelope of the installation, and wherein the production heads are locatable from the bottom of the sea up to a point above the surface of the sea.

6. System according to claim 1, wherein the production, injection or control wells have their upper part disposed on a cylindrical surface surrounding the separator flasks or are inside the flasks in the space when said flasks are toric, or simultaneously when a large number of wells is required for working the deposit.

7. System according to claim 1, wherein at least a part of the operating means necessary for the regulation and the working of the installation, is arranged at or proximate the surface of the sea whereby equipment requiring periodic changes is accessible from the surface.

8. System according to claim 1, comprising means for rapid disconnection to disconnect and detach the installations from the components remaining on the seabed and for reconnecting them subsequently to said components and other submerged parts, disconnection means when the installation is in sections, facilitating adjustments by successive removal or addition of the height of the installation to the depth of the seawater.

9. System according to claim 1, comprising a storage container for increasing the flexibility of operation, for absoring flow surges and to permit interruptions in delivery without stopping the production of the wells.

10. System according to claim 1, wherein the regulation of the level in the separator flask is effected through a manometric height differential between a water column and a water-oil column to provide for flexibility and fineness of regulation, which is independent of variations in the level of the sea, whereby said level regulation can be replaced, complemented, or assisted by a regulation device for the detection of variations in weight, or stresses direct and differential of the separator flask.

11. System according to claim 1, comprising means for insulating the effluent from the outside medium extending from the base of the installation and to heat or cool the installation when the thermal conditions of the flow of the effluent are a factor in the working of the deposit.

12. System according to claim 1, wherein the system is installed in a support adapted to be installed or removed, integrally or by sections including means of attachment to the seabed consisting of a metal structure, a weighted metal or concrete base, a column articulated at its base and at at least one point, an anchorage with catenary cables.

13. System according to claim 1, wherein the installation has a pencil-shape, in of small variable section and of extensive height the submerged part of which contains at least part of the equipment.

14. System according to claim 1, comprising modules assembled with variable configuration through standard modular elements whereby the installation can be adjusted and modified during the course of working a deposit, to conform to characteristics of the effluent and to the enviornment, and can be applied to one or more wells successively.

15. System according to claim 1, comprising tight compartments imparting buoyancy to enable it to float before connection to the base and upon one or more of these compartments or the envelope of the installations being ripped or gutted.

* * * * *

UNITED STATES PATENT OFFICE

CERTIFICATE OF CORRECTION

Patent No. 4,506,735 Dated March 26, 1985

Inventor(s) Gerard Chaudot

It is certified that error appears in the above-identified patent and that said Letters Patent are hereby corrected as shown below:

Column 2, line 5: after "feasible", insert --only with extreme difficulty and at a prohibitively high--.

Column 4, line 49: "protect" should be --protective hull--.

Column 4, line 68: "a system" should be --a working system--.

Column 5, line 9: "hull" should be --hull--.

Column 5, line 12: "numerale" should be --numerals--.

Column 7, line 58: after "differing" insert --from--.

Column 8, line 41: "skirt 108" should be --skirt 105--.

Signed and Sealed this

*Twenty-fifth* Day of *March 1986*

[SEAL]

*Attest:*

DONALD J. QUIGG

*Attesting Officer*

*Commissioner of Patents and Trademarks*